US006085917A

United States Patent [19]

Odom

[11] Patent Number: 6,085,917

[45] Date of Patent: Jul. 11, 2000

[54] SHELF-MOUNTED, SPRING-LOADED STORAGE DEVICE

[76] Inventor: Anne M. Odom, 925 Windsor Rd., Virginia Beach, Va. 23451

[21] Appl. No.: 09/265,618

[22] Filed: Mar. 10, 1999

[51] Int. Cl.[7] ..... A47F 7/00

[52] U.S. Cl. ..... 211/119.003; 211/47; 211/96; 248/229.26; 248/453

[58] Field of Search ..... 211/119.003, 42, 211/45, 47, 41.5, 41.6, 96; 248/229.16, 229.26, 250, 316.7, 447.2, 451–453

[56] References Cited

U.S. PATENT DOCUMENTS

| | | | |
|---|---|---|---|
| 816,380 | 3/1906 | Ruger | 248/452 |
| 884,722 | 4/1908 | Davis | 248/452 |
| 910,158 | 1/1909 | Walker | 248/229.16 |
| 1,087,664 | 2/1914 | Keller | 248/214 |
| 1,161,339 | 11/1915 | Putnam | 248/452 |
| 1,372,205 | 3/1921 | Smith | 211/86.01 |
| 1,403,004 | 1/1922 | Beckers | 248/229.16 |
| 1,858,656 | 5/1932 | Batherman | 248/229.16 |
| 1,939,206 | 12/1933 | Dougherty | 248/452 |
| 2,273,584 | 2/1942 | Moore | 248/452 X |
| 2,524,617 | 10/1950 | Wyse | 248/452 X |
| 2,538,318 | 1/1951 | Mitchell | 248/448 |
| 2,598,029 | 5/1952 | Baldwin | 248/452 X |
| 3,772,742 | 11/1973 | Gigante | 248/452 X |
| 4,015,813 | 4/1977 | Graham | 248/452 |
| 5,082,229 | 1/1992 | Dahl | 248/453 X |
| 5,375,806 | 12/1994 | Debus et al. | 248/452 |
| 5,586,741 | 12/1996 | Cuneo | 248/229.26 |
| 5,765,799 | 6/1998 | Weber | 248/453 |

*Primary Examiner*—Daniel P. Stodola
*Assistant Examiner*—Jennifer E. Novosad
*Attorney, Agent, or Firm*—Peter J. Van Bergen

[57] ABSTRACT

A storage device is provided for use with a shelf having an accessible edge. A frame is formed from a single piece of rod stock that is shaped to define first and second U-shaped members that can slidably engage the accessible edge of the shelf. The first and second U-shaped members are coupled to one another in a spaced-apart opposing fashion by a portion of the frame that is spaced a distance from the first and second U-shaped members. In this way, when the first and second U-shaped members engage the accessible edge of the shelf, the portion of the frame is positioned away from the accessible edge of the shelf to extend along and under the shelf. A plate is hingedly coupled to the portion of the frame that couples the first and second U-shaped members to one another. The plate extends from this portion of the frame to approximately the accessible edge of the shelf. The plate is biased to rotate relative to this portion of the frame so that when the frame is mounted to the shelf, the plate is biased towards the shelf.

24 Claims, 3 Drawing Sheets

SHELF-MOUNTED, SPRING-LOADED STORAGE DEVICE

FIELD OF THE INVENTION

The invention relates generally to storage devices, and more particularly to a storage device adapted to be mounted on a shelf or other planar surface and hold articles therebetween.

BACKGROUND OF THE INVENTION

Utilizing storage space efficiently is of interest to home and business owners. Very often, storage space in existing cabinets, closets, pantries and/or shelving units is inefficiently utilized. For example, shelf spacing can be greater than needed thereby wasting useful space beneath a shelf. Also, when items being stored are flaccid (e.g., plastic or paper shopping bags, rags, scarves, etc.), the items may not lend themselves to efficient stacking.

SUMMARY OF THE INVENTION

Accordingly, it is an object of the present invention to provide a storage device that can be used to efficiently store flaccid and other non-stackable or odd items in existing shelf storage areas.

Another object of the present invention is to provide a storage device that works with existing shelving to increase the storage capacity thereof.

Still another object of the present invention is to provide a storage device that can be positioned where needed in an existing cabinet, closet, pantry or shelving unit.

A further object of the present invention is to provide a storage device requiring no hardware for mounting same to a shelf or other planar surface.

Other objects and advantages of the present invention will become more obvious hereinafter in the specification and drawings.

In accordance with the present invention, a storage device includes a frame and a plate hingedly coupled to the frame. The frame can be formed from a single piece of rod stock and shaped to define first and second U-shaped members coupled and fixed relative to one another in a spaced-apart opposing fashion. The plate has a first edge and a second edge with the first edge being hingedly coupled to the frame between its U-shaped members. The plate is biased to rotate about the frame so that when the U-shaped members engage a planar surface, the plate is biased towards the planar surface. The plate is shaped between its first and second edges to define one or more compartments when the plate is biased against the planar surface.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
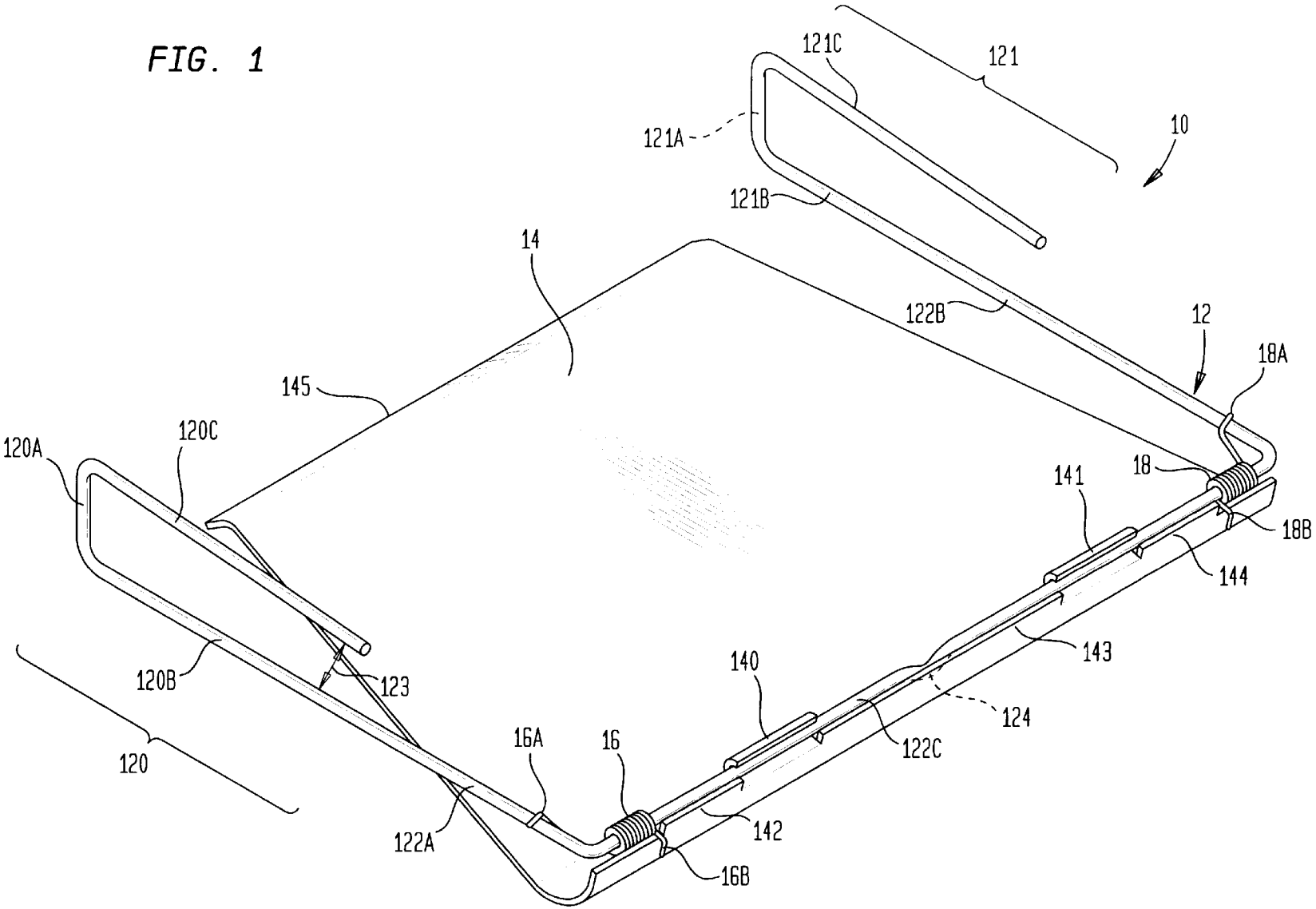
FIG. 1 is a perspective view of one embodiment of a storage device according to the present invention prior to its installation on a shelf or other planar surface.
Figure 2:
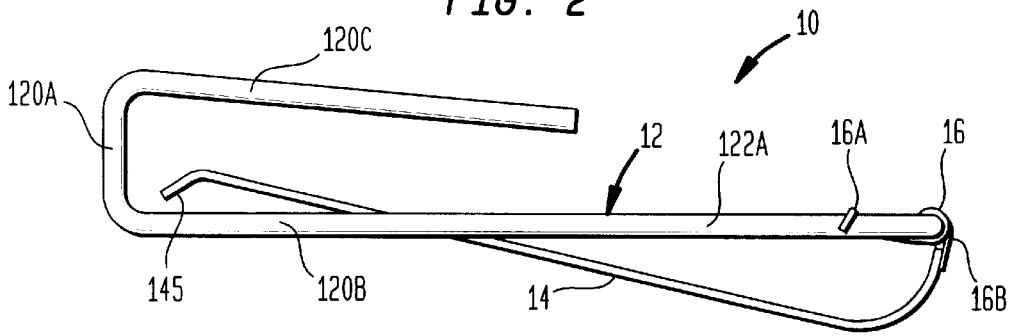
FIG. 2 is a side view of the storage device prior to its installation on a shelf or other planar surface.

Referring now to the drawings, and more particularly and simultaneously to FIGS. 1 and 2, an embodiment of a storage device 10 according to the present invention is illustrated in perspective and side views, respectively. As will be explained further below, storage device 10 can be mounted to the edge of a shelf or other planar surface and used to hold a variety of articles thereagainst for storage purposes.

Storage device 10 has a frame 12 typically made from solid or hollow rod stock material. The material could be metal, plastic or a composite capable of being formed as shown and as will be described. Frame 12 could be shaped from a single piece of rod stock or from several pieces connected together. By way of example, one particular shaping of frame 12 is illustrated. More specifically, frame 12 is shaped to define U-shaped members 120 and 121 at either end of frame 12. U-shaped members 120 and 121 oppose one another and are coupled to one another by a C-shaped central frame portion comprising a first leg 122A, and a second leg 122B and a coupling leg 122C. U-shaped member 120 has a base 120A and legs 120B and 120C extending therefrom and angled toward one another. Similarly, U-shaped member 121 has a base 121A with legs 121B and 121C extending therefrom and angled towards one another. The spacing between a U-shaped member's legs at its base should be large enough to accommodate the width of a shelf or other planar surface to which storage device 10 will be mounted. The spacing between a U-shaped member's legs at its open end (e.g., the open end illustrated by two-headed arrow 123 for U-shaped member 120) should be slightly less than the width of the shelf or other planar surface to which storage device 10 will be mounted.

As mentioned above, a central frame portion connects U-shaped members 120 and 121 together in a fixed and space-apart relationship to one another. In the illustrated example, the central frame portion is substantially C-shaped with first and second legs 122A and 122B connected to legs 120B and 121B of U-shaped members 120 and 121, respectively. While coupling leg 122C connects each of legs 122A and 122B. Coupling leg 122C can be notched at 124 to serve as a stop as will be explained further below.

A plate 14 is hingedly coupled to frame 12. More specifically, plate 14 is hingedly coupled to coupling leg 122C at either side of stop notch 124. While such hinged coupling can be accomplished in a variety of ways, one way is illustrated in which plate 14 is shaped to hinge with coupling leg 122C without the need for any additional hardware. To accomplish this, a hinging edge of plate 14 incorporates two shaped tabs 140 and 141 interleaved with three planar tabs 142, 143 and 144. Shaped tabs 140 and 141 are wrapped loosely and partially about coupling leg 122C from one side thereof and planar tabs 142, 143 and 144 engage coupling leg 122C on the other side thereof to lock coupling leg 122C into shaped tabs 140 and 141. The loose fitting of shaped tabs 140 and 141 about coupling leg 122C allows plate 14 to freely pivot about coupling leg 122C.

As just described, plate 14 is hingedly coupled to frame 12 at one edge thereof. Note that the particular shape of lipped edge 145 is not a limitation of the present invention. For example, lipped edge 145 could be shaped to define a finger grip if desired. Plate 14 extends to a second edge thereof which can be formed to define a lipped edge 145 as shown. Plate 14 can also be shaped between its hinging edge and lipped edge 145. In the illustrated example, plate 14 is substantially L-shaped in cross-section between its hinging edge and lipped edge 145. The L-shape of plate 14 provides for a general use storage device that defines a single compartment as will become apparent below. However, other cross-sectional shapes of plate 14 could be used in the present invention. For example, plate 14 could be repetitively shaped (e.g., sinusoidal or S-shaped, multiple triangles, etc.) between its hinging edge and lipped edge 145 to define multiple compartments. Further, in the illustrated example, plate 14 tapers in width between its hinging edge and lipped edge 145. However, plate 14 could also expand in width to extend beyond U-shaped members 120 and 121 as will be described further below.

Plate 14 is biased to rotate about frame 12 such that when storage device 10 is mounted on a shelf or other planar surface, plate 14 is biased towards the shelf or other planar surface to hold articles thereagainst as will be explained further below. In the illustrated embodiment, plate 14 is biased relative to frame 12 such that plate 14 will rotate through U-shaped members 120 and 121. The necessary bias could be built into plate 14, i.e., plate 14 could be hinged to frame 12 in a way that a naturally-biased rotation will occur. A positive means for biasing plate 14 could also be provided. For example, one or more springs can be coupled between frame 12 and plate 14. As illustrated, first and second coil springs 16 and 18 are coiled about coupling member 122C. Ends 16A and 18A of springs 16 and 18 engage legs 122A and 122B, respectively, while other ends 16B and 18B of springs 16 and 18 engage plate 14 as shown. Stop notch 124 serves to limit spring-biased rotation of plate 14 about frame 12 (and retain springs 16 and 18 in position) when storage device 10 is not mounted on a shelf or other planar surface. The function of stop notch 124 could also be achieved by attaching a protuberance to coupling leg 122C.

Figure 3:
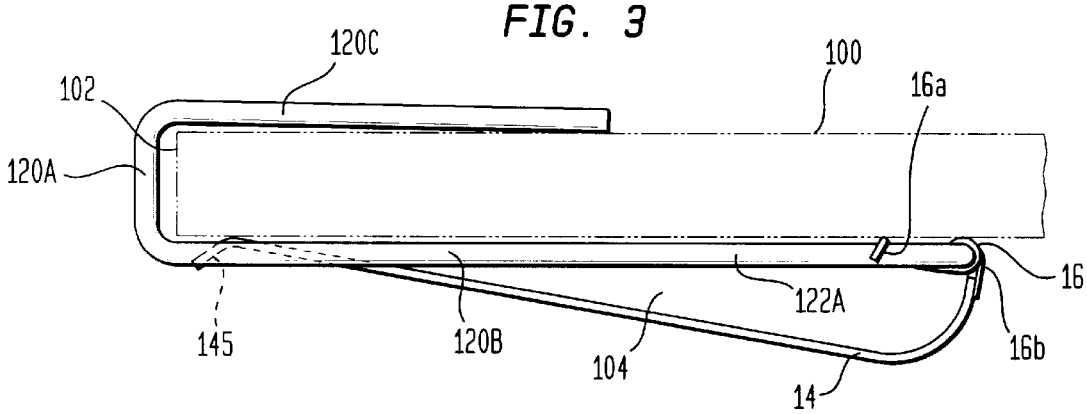
FIG. 3 is a side view of the storage device installed on a shelf or other planar surface in its normal closed position.

In use, storage device 10 is mounted to a shelf 100 as illustrated in FIG. 3. Shelf 100 is representative of any horizontal or vertical planar surface having an exposed edge 102 onto which U-shaped members 120 and 121 can be slid. Since each of U-shaped members 120 and 121 is tapered as described above, shelf 100 is positively gripped by frame 12. To prevent cosmetic damage to shelf 100, each of U-shaped members 120 and 121 can be covered with a rubber boot or coated with a non-scratching material (not shown). The bias provided by springs 16 and 18 presses plate 14 against shelf 100. For the illustrated example, lipped edge 145 contacts shelf 100. Accordingly, lipped edge 145 can also be booted or coated to prevent cosmetic damage to shelf 100. Alternatively, a pad or cushion (not shown) can be applied to lipped edge 145, where it will contact shelf 100.

Figure 4:
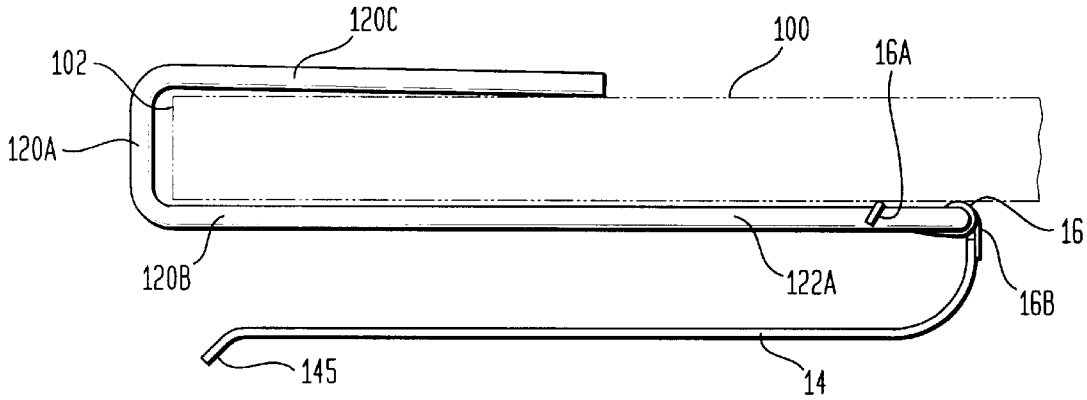
FIG. 4 is a side view of the storage device installed on a shelf or other planar surface in its normal open position.

The shape of plate 14 creates a gap 104 between plate 14 and shelf 100 that serves as compartmentalized storage space for articles such as plastic bags, rags, scarves, newspapers, mail, books, magazines, paper grocery bags, etc. Gap 104 is accessible from either side of plate 14 so that articles retained by plate 14 can be easily inserted or removed. One can grasp lipped edge 145 and rotate plate 14 away from shelf 100 to gain access to the storage space defined between plate 14 and shelf 100 as illustrated in FIG. 4.

Figure 5:
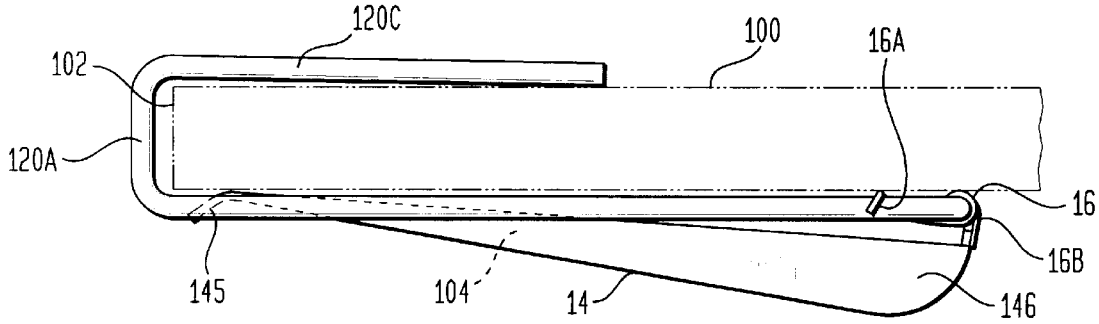
FIG. 5 is a side view of another embodiment of the storage device of the present invention.

Plate 14 could also be shaped to incorporate sides on one or both sides of gap 104. For example, as illustrated in FIG. 5, a side 146 incorporated into plate 14 on the near side thereof means that gap 104 would only be accessible from one side of plate 14, i.e., the left side of plate 14 as viewed from edge 102. Of course, the far side of plate 14 could also incorporate a side (not shown) to effectively enclose gap 104 when plate 14 is up against shelf 100. In this way, the present invention could also be used to hold smaller items, e.g., pens, pins, buttons, golf tees, nails, etc.

The advantages of the present invention are numerous. The present invention provides a simple and efficient way of storing flaccid, non-stackable items against a shelf or other horizontal or vertical planar surface. The storage device is easily positioned where needed and can be installed/repositioned without any hardware or tools. The simple construction of the present invention provides a cost-effective approach to improving the storage capabilities of any existing storage facility having a vertical or horizontal planar surface onto which the frame of the present invention can be mounted.

Figure 6:
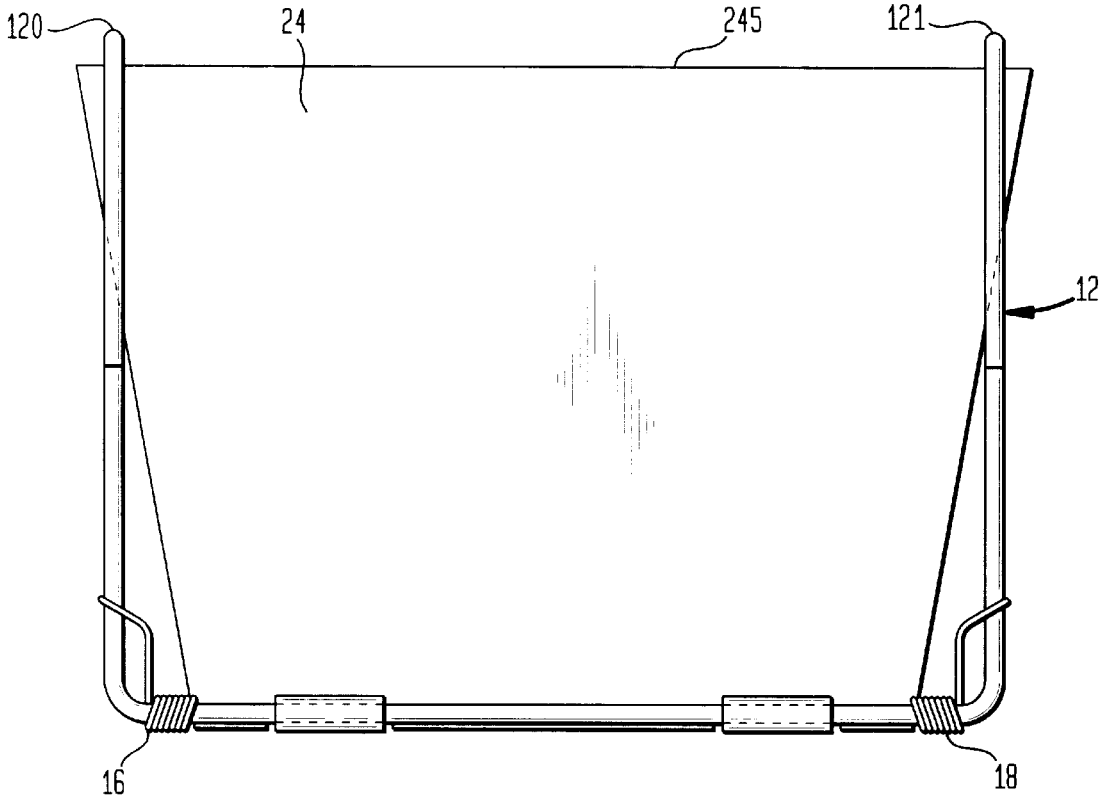
FIG. 6 is a plan view of another embodiment of the storage device of the present invention.
Figure 7:
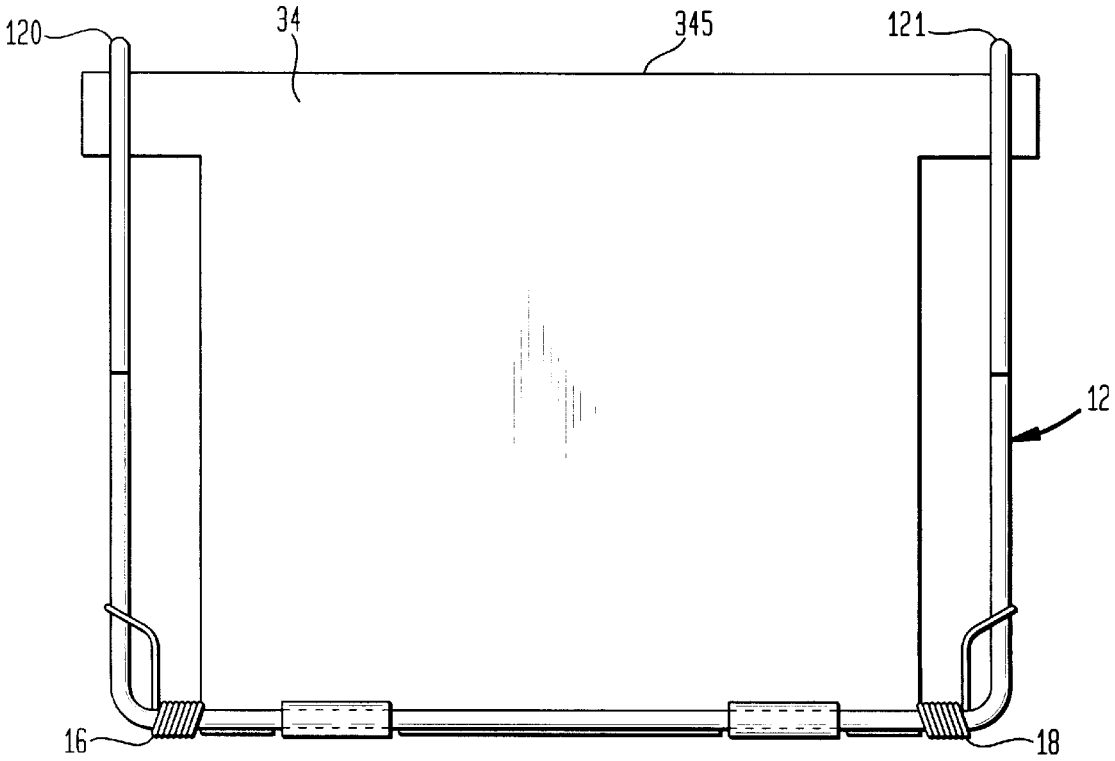
FIG. 7 is a plan view of still another embodiment of the storage device of the present invention.

Although the invention has been described relative to a specific embodiment thereof, there are numerous variations and modifications that will be readily apparent to those skilled in the art in light of the above teachings. For example, as illustrated in FIGS. 6 and 7, the plate in the present invention can be shaped other than as described above. In FIG. 6, a plate 24 is mounted to frame 12 as described above. However, plate 24 gradually expands in width from its hinged edge to its (lipped) edge 245. Specifically, plate 24 is wider at edge 245 than the spacing between U-shaped members 120 and 121. In this embodiment, U-shaped members 120 and 121 limit the spring-biased rotation of plate 24 about frame 12 as plate 24 rests against frame 12. Accordingly, a stop notch (e.g., stop notch 124) need not be incorporated or attached to frame 12. In FIG. 7, a plate 34 is T-shaped such that its (lipped) edge 345 forms the top of a "T" that extends beyond the spacing between U-shaped members 120 and 121. In general, the plate could extend beyond U-shaped members 120 and 121 at any point between the plate's hinged edge and outer (lipped) edge in order to eliminate the need for stop notch 124. Note that the elimination of stop notch 124 could also be achieved by toeing in U-shaped members 120 and 121 towards one another. It is therefore to be understood that, within the scope of the appended claims, the invention may be practiced other than as specifically described.

What is claimed as new and desired to be secured by Letters Patent of the United States is:

1. A storage device for use with a shelf having an accessible edge, comprising:

a frame formed from a single niece of rod stock shaped to define first and second U-shaped members that can slidably engage the accessible edge of the shelf, said first and second U-shaped members coupled to one another in a spaced-apart opposing fashion by a portion of said frame spaced a distance from said first and second U-shaped members such that, when said first and second U-shaped members engage the accessible edge of the shelf, said portion of said frame is positioned away from the accessible edge of the shelf to extend along and under the shelf; and a plate hingedly coupled to said portion of said frame, said plate extending from said portion of said frame to approximately the accessible edge of the shelf, said plate biased to rotate relative to said portion of said frame wherein, when said frame is mounted to the shelf, said plate is biased towards the shelf wherein items can be stored between said plate and said shelf.

2. A storage device as in claim 1 wherein a first edge of said plate is hingedly coupled to said rod stock between said first and second U-shaped members, said plate extending to a second edge thereof opposing said first edge.

3. A storage device as in claim 2 wherein said first edge defines a sleeve receiving said portion of said frame therethrough, said sleeve comprising:

at least one shaped tab wrapping partially about said portion of said frame; and straight tabs positioned on either side of said at least one shaped tab.

4. A storage device as in claim 2 wherein said plate tapers in width from said first edge to said second edge.

5. A storage device as in claim 2 wherein said plate expands in width between said first edge and said second edge, wherein at least a portion of said plate extends beyond said first and second U-shaped members.

6. A storage device as in claim 2 wherein said second edge is a lipped edge.

7. A storage device as in claim 1 wherein each of said first and second U-shaped members comprises a base with first and second legs extending from said base and angled towards one another.

8. A storage device as in claim 7 further comprising a stop fixedly coupled to one of said plate and said frame for limiting rotation of said plate relative to said frame when said frame is not mounted to the shelf.

9. A storage device as in claim 1 further comprising at least one spring coupled between said frame and said plate for biasing said plate for rotation relative to said frame.

10. A storage system, comprising:

a shelf having an accessible edge;

a frame formed from a single piece of rod stock shaped to define first and second U-shaped members coupled and fixed relative to one another in a spaced-apart opposing fashion by a coupling portion of said piece of rod stock that is spaced a distance from said first and second U-shaped members, said first and second U-shaped members engaging said accessible edge and said portion of said frame being positioned away from said accessible edge to extend along and under said shelf; and a plate having a first edge hingedly coupled to said coupling portion and biased to rotate relative to said coupling portion and towards said shelf, said plate extending to a second edge positioned approximately along said accessible edge of said shelf, wherein items can be stored between said plate and said shelf.

11. A storage system as in claim 10 wherein said first edge defines a sleeve receiving said coupling portion therethrough, said sleeve comprising:

at least one shaped tab wrapping partially about said coupling portion; and straight tabs positioned on either side of said at least one shaped tab.

12. A storage system as in claim 10 wherein each of said first and second U-shaped members comprises a base with first and second legs extending from said base and angled towards one another.

13. A storage system as in claim 10 further comprising at least one spring coupled between said coupling portion and said plate for biasing said plate for rotation relative to said coupling portion.

14. A storage system as in claim 10 further comprising a stop fixedly coupled to one of said plate and said coupling portion for limiting rotation of said plate relative to said coupling portion when said frame is not mounted to said shelf.

15. A storage system as in claim 10, wherein said plate tapers in width from said first edge to said second edge.

16. A storage system as in claim 10 wherein said plate expands in width between said first edge an said second edge, wherein at least a portion of said plate extends beyond said first and second U-shaped members.

17. A storage system as in claim 10 wherein said second edge is a lipped edge.

18. A storage system, comprising:

a shelf having an accessible edge;

a frame formed from a single piece of rod stock shaped to define first and second U-shaped members coupled to one another in a spaced-apart opposing fashion by a coupling portion of said piece of rod stock that is spaced a distance from said first and second U-shaped members, said first and second U-shaped members engaging said accessible edge and said portion of said frame being positioned away from said accessible edge to extend along and under said shelf;

a plate having a first edge hingedly coupled to said coupling portion, said plate extending to a second edge positioned approximately along said accessible edge of said shelf; and at least one spring coupled between said frame and said plate for biasing said plate for rotation relative to said frame, wherein items can be stored between said plate and said shelf.

19. A storage system as in claim 18 wherein said first edge defines a sleeve receiving said coupling portion therethrough, said sleeve comprising:

at least one shaped tab wrapping partially about said coupling portion; and straight tabs positioned on either side of said at least one shaped tab.

20. A storage system as in claim 18 wherein each of said first and second U-shaped members comprises a base with first and second legs extending from said base and angled towards one another.

21. A storage system as in claim 18 further comprising a stop fixedly coupled to one of said plate and said coupling portion for limiting rotation of said plate relative to said coupling portion when said frame is not mounted to said shelf.

22. A storage system as in claim 18 wherein said plate tapers in width from said first edge to said second edge.

23. A storage system as in claim 18 wherein said plate expands in width between said first edge and said second edge, wherein at least a portion of said plate extends beyond said first and second U-shaped members.

24. A storage system as in claim 18 wherein said second edge is a lipped edge.

* * * * *